United States Patent [19]

Bolton

[11] Patent Number: 4,523,080

[45] Date of Patent: Jun. 11, 1985

[54] APPARATUS FOR TREATMENT OF HAIR AND SCALP

[76] Inventor: John D. Bolton, 5 Shiloh Cir., Irvine, Calif. 92714

[21] Appl. No.: 444,422

[22] Filed: Mar. 14, 1983

[51] Int. Cl.[3] ..... A45D 7/02; A45D 20/09; B05B 7/16

[52] U.S. Cl. ..... 219/362; 34/90; 34/97; 132/7; 132/9; 219/370; 239/289

[58] Field of Search ..... 219/362, 366, 368, 369–371, 219/373, 271–273; 34/90, 96–101; 132/7, 9, 11, 112, 114; 239/132, 133, 289

[56] References Cited

U.S. PATENT DOCUMENTS

| | | | |
|---|---|---|---|
| 2,983,650 | 5/1961 | Rubin | 132/7 |
| 3,217,938 | 11/1965 | Ayres | 239/132 |
| 3,437,791 | 5/1969 | Gardner | 239/135 |
| 3,636,963 | 1/1972 | Olson | 132/112 |
| 3,702,616 | 11/1972 | Mercer | 132/112 |
| 3,714,950 | 2/1973 | Miska et al. | 132/112 |
| 3,721,250 | 3/1973 | Walter et al. | 219/370 |
| 3,854,489 | 12/1974 | Doyle et al. | 219/370 |
| 3,894,547 | 7/1975 | Scivoletto | 219/370 |
| 3,905,379 | 9/1975 | Churas et al. | 219/370 |
| 3,947,659 | 3/1976 | Ono | 219/362 |
| 4,114,022 | 9/1978 | Braulke | 219/362 |
| 4,166,473 | 9/1979 | Bauer et al. | 219/271 |
| 4,256,127 | 3/1981 | Tsujimoto et al. | 132/7 |
| 4,314,138 | 2/1982 | Itoh | 219/362 |
| 4,376,441 | 3/1983 | Duncan | 132/112 |

FOREIGN PATENT DOCUMENTS

| | | | |
|---|---|---|---|
| 175972 | 9/1953 | Austria | 239/132 |

*Primary Examiner*—Roy N. Envall, Jr.
*Assistant Examiner*—Geoffrey S. Evans

[57] ABSTRACT

This invention is that of a hair dryer in combination with an aerosol spray can arranged in such a way that the spray from the aerosol can is directed into the hot air stream of the dryer. There is in addition a trigger mechanism that actuates the spray can for convenient intermittent use by the user.

1 Claim, 1 Drawing Figure

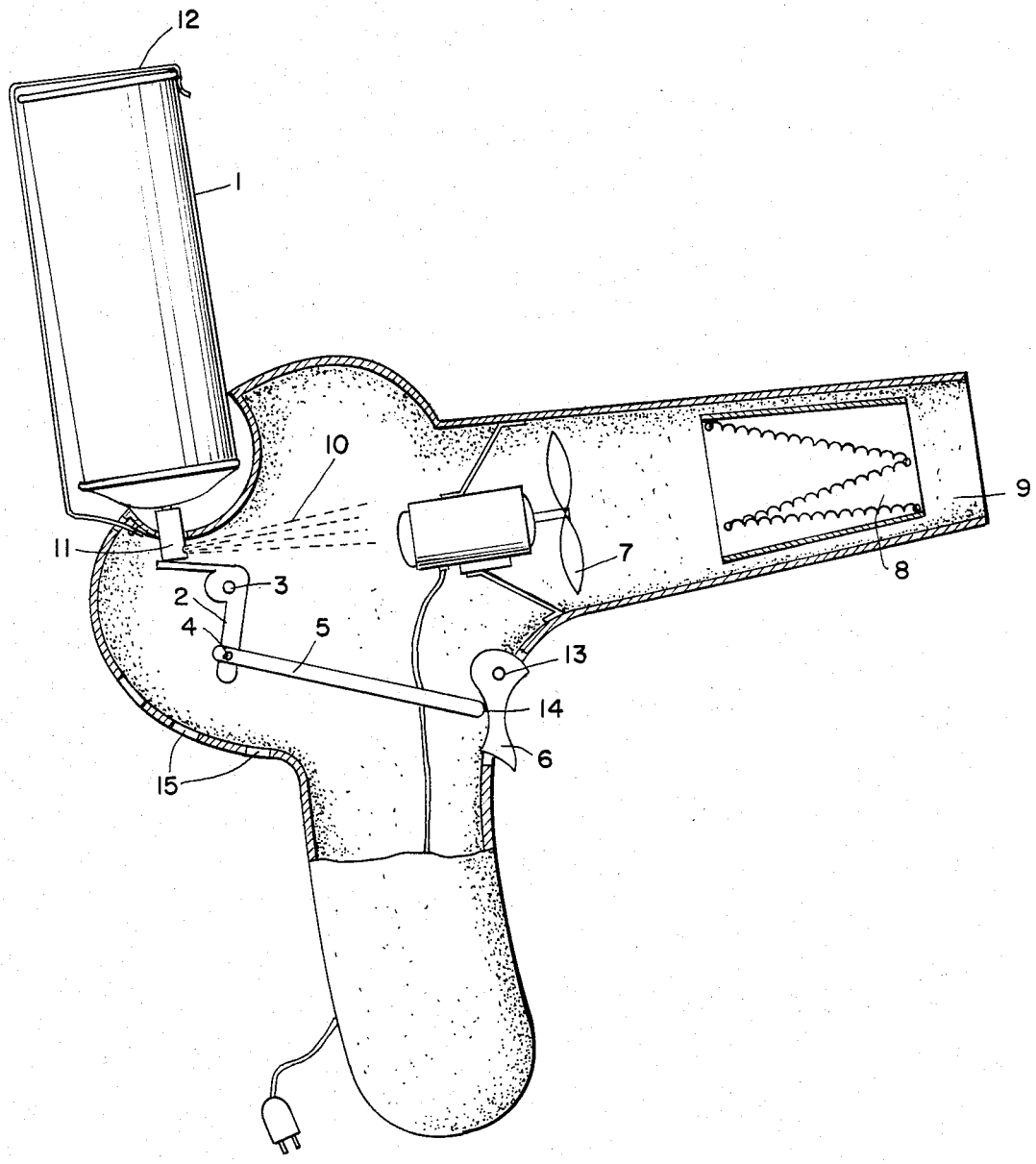
12
1
10
9
11
7
8
2
3
4
5
13
14
6
15

APPARATUS FOR TREATMENT OF HAIR AND SCALP

FIELD OF THE INVENTION

This apparatus relates to the art of drying hair and scalp with forced heated air and the addition to the hair and scalp of compositions of matter to give fragrance, color, body, sheen to hair and to aid in the retention of placement of hair and treat hair and scalp for medical problems.

DESCRIPTION OF THE PRIOR ART

At the present time drying hair with a forced heated air is a wide practice. Homes and beauty shops have a variety of "blow driers" available. In addition it is common practice to apply to the hair and scalp all manner of conditioners and treatments from spray cans. These are relatively small pressurized cans also widely known as aersol sprays which contain a propellant, a composition usually dissolved therein for which some benefit to hair or scalp is claimed, and a release valve and nozzle combination. The nozzle is produced in such a way that depressing it releases the contents through the nozzle. The nozzle orifice is designed in such a way that when the compound and propellant rush through, driven by the pressure in the can, the materials emerge in a spray rather than in a stream. I will henceforth refer to this combination as an aerosol spray can.

At the present time the dryer and the aerosol can have to be used separately. There is no apparatus to combine them in such a way that the user might conveniently use both at the same time.

The spray has to be applied at room temperature. There is no convenient way to heat the spray stream and the beneficial advantages of the application of heat are not available.

SUMMARY OF THE INVENTION

The invention is a new combination of blow hair dryer and aerosol spray can in combination. The object of my invention is to provide a convenient combination of spray can and blow drier which can be used at the same time. Another object of my invention is to provide an apparatus that has enhanced mixing and dispersal of compounds. Another object of my invention is to reap the benefits of applying the compounds and conditioners hot.

BRIEF DESCRIPTION OF THE DRAWINGS

In the drawings FIG. 1 is a cross section of my apparatus.

DESCRIPTION OF THE PREFERRED EMBODIMENT

In referring to the specific embodiment of my invention specific terminology will be resorted to for the sake of clarity. However it is not intended to be limited to the specific terms so selected, and it is to be understood that each specific term includes all technical equivalents which operate in a similar manner to accomplish a similar purpose.

Turning now to the specific embodiment of my invention chosen for illustration,

1 is an aerosol spray can,

2 is an "L" shaped bar with a hole therein 3, and a pivot pin through the said hole into the body of the dryer.

4 is an opening in the said "L" shaped bar 1 into which is pivoted the trigger movement transfer bar 5.

6 is a trigger with opening at 13 and a pivot into the body of the dryer at that point, and pocket 14, to receive the trigger movement transfer bar.

7 is the tubular blower fan,

8 is an electrical resistance heating coil,

9 is an air outlet hole,

10 is the edge of the aerosol spray pattern,

11 is the aerosol spray can valve-nozzle combination,

13 is a bracket to receive and hold the spray can in place,

15 is an air inlet hole.

OPERATION OF THE APPARATUS

In operation the user places the spray can in the cavity intended to receive the can in the back of the hair dryer and latches the holding device 12 over the can to hold it into place. He commences to use the hair blow dryer in the ordinary way, usually moving back and forth over the hair and scalp with the opening 9 pointing to, and close to, the hair and scalp. When the user decides he would like to apply some of the compound in the spray can he depresses the trigger and holds it depressed as long as he wishes to continue to apply the compound in the spray can. When he decides enough has been applied he releases the trigger.

It is to be understood that the form of my invention selected for illustration is but one particular embodiment selected for illustration. Various changes may be made in the shape, size and arrangement of the parts all without departing from the scope and spirit of my invention. The spray can 1, may be inserted vertically with nozzle up or down or horizontally, the only limitation being that the nozzle has to be directed to release the spray in the direction of the dryer air stream. There can be all manner of variations and configurations of hair driers, those that heat the air first, then propel it, those that propel first and heat second, those that have propeller fans, those that have bird cage rotational fans, those with one heat level, those with several heating levels. The release mechanism may be a trigger in the handle, a thumb button on the back or the spray may be actuated by the operation of the dryer and be continuous as long as the dryer is operating. The spray may be directed to the heating coils, the hottest part of the air stream, the cooler parts.

Having thus described and disclosed my invention, I claim:

1. Apparatus for treating hair comprising, a hand held hair dryer having an air inlet and an air outlet, blower means in the hair dryer for producing a stream of air between the air inlet and the air outlet, attaching means for attaching an aerosol spray can to the hair dryer between the air inlet and the blower means so that aerosol spray leaving a nozzle of the aerosol spray can contact said stream of air between the blower means and the air inlet, whereby the blower means thoroughly mixes said stream of air and said aerosol spray, heater means between the blower means and the air outlet to the said mixed stream of air and aerosol spray, and manual trigger means on the hair dryer and connected to the aerosol spray can for controlling the flow of said aerosol spray into said stream of air.

* * * * *